United States Patent [19]

Borst

[11] Patent Number: 5,016,597

[45] Date of Patent: May 21, 1991

[54] CRANKSHAFT DRIVEN COMPRESSOR FOR SUPPLYING AIR TO A FUEL INJECTION MECHANISM

[75] Inventor: Gaylord M. Borst, Gurnee, Ill.

[73] Assignee: Outboard Marine Corporation, Waukegan, Ill.

[21] Appl. No.: 352,874

[22] Filed: May 17, 1989

[51] Int. Cl.[5] ..... F02M 67/02

[52] U.S. Cl. ..... 123/533; 123/73 C

[58] Field of Search ..... 123/55 R, 55 A, 73 C, 123/531, 533, 70 R; 417/271, 273, 364

[56] References Cited

U.S. PATENT DOCUMENTS

| | | | |
|---|---|---|---|
| B 416,933 | 1/1975 | Gaines et al. | 417/53 |
| 1,316,346 | 9/1919 | Augustine | 123/533 |
| 2,215,911 | 9/1940 | Peterson | 123/533 X |
| 2,710,600 | 6/1955 | Nallinger | 123/533 |
| 3,682,572 | 8/1972 | Yarger | 417/273 |
| 3,704,079 | 11/1972 | Berlyn | 417/438 |
| 4,270,439 | 6/1981 | Ponchaux | 91/495 |
| 4,313,714 | 2/1982 | Kubeczka | 417/273 |
| 4,429,674 | 2/1984 | Lübbing | 123/531 |
| 4,446,821 | 5/1984 | Cataldo | 123/26 |
| 4,465,050 | 8/1984 | Igashira et al. | 123/472 |
| 4,556,037 | 12/1985 | Wisdom | 123/531 |
| 4,568,265 | 2/1986 | Firey | 431/1 |
| 4,645,428 | 2/1987 | Arregui et al. | 417/273 |
| 4,674,462 | 6/1987 | Koch et al. | 123/533 |
| 4,727,794 | 3/1988 | Kmicikiewicz | 123/55 A X |
| 4,771,754 | 9/1988 | Reinke | 123/533 |
| 4,794,901 | 1/1989 | Hong et al. | 123/73 C |
| 4,823,756 | 4/1989 | Ziejewski et al. | 123/531 |

*Primary Examiner*—Willis R. Wolfe

*Attorney, Agent, or Firm*—Michael, Best & Friedrich

[57] ABSTRACT

Disclosed herein is an engine comprising an engine block, a crankshaft rotatably mounted on the engine block, having an axis, and including a cylindrical surface in excentric relation to the crankshaft axes, a plurality of cylinders supported by the engine block in a common plane and having respective axis extending radially from the crankshaft axis, which cylinders each have a radially outer end including an outlet valve, a plurality of pistons respectively movable in the cylinders, each of which pistons includes an air inlet valve, a plurality of connecting rods respectively pivotally connected to the pistons, and a drive hub rotatably mounted on the crankshaft surface and pivotally connected to the connecting rod such that crankshaft rotation causes reciprocation of the pistons in the cylinders and pumping of air into the cylinders through the inlet valves and out of the cylinders through the outlet valves.

20 Claims, 2 Drawing Sheets

CRANKSHAFT DRIVEN COMPRESSOR FOR SUPPLYING AIR TO A FUEL INJECTION MECHANISM

BACKGROUND OF THE INVENTION

The invention relates generally to internal combustion engines. More particularly, the invention relates to arrangements for supplying fuel to such engines and for injecting the fuel into such engines. Still more particularly, the invention relates to arrangements for atomizing and conveying such atomized fuel into a spark ignited combustion chamber by mixing the fuel with an incoming charge of compressed gas, such as air.

Attention is directed to the following U.S. Pat. Nos.:

| | | |
|---|---|---|
| 2,710,600 | F. K. H. Nallinger | June 14, 1955 |
| 3,066,983 | J. A. M. Bay | December 4, 1962 |
| 3,288,072 | W. G. McKenzie | November 29, 1966 |
| 3,442,443 | E. L. Kilbourn | May 6, 1969 |
| 3,682,572 | D. L. Yarger | August 8, 1972 |
| 3,704,079 | M. J. Berlyn | November 28, 1972 |

SUMMARY OF THE INVENTION

The invention provides an engine comprising an engine block defining an engine cylinder, a fuel injection mechanism connected to the engine cylinder, a crankshaft rotatably mounted on the engine block, means for compressing air in response to crankshaft rotation, and means for supplying the compressed air to the fuel injection mechanism in preselected timed relation to crankshaft rotation.

The invention also provides an engine comprising an engine block defining a plurality of engine cylinders, a like plurality of fuel injection mechanisms respectively connected to the engine cylinders, a crankshaft rotatably mounted on the engine block and having an axis, a like plurality of air compressing cylinders supported on the engine block and having respective axes extending radially from the crankshaft axis, a like plurality of air compressing pistons respectively movable in the air compressing cylinders, means for admitting air to the air compressing cylinders in response to air compressing piston movement, means for discharging air from the air compressing cylinders in response to air compressing piston movement, means connecting the crankshaft to the air compressing pistons for effecting air compressing piston reciprocation in the air compressing cylinders in response to crankshaft rotation, and means respectively connecting the plurality of air compressing cylinders to the plurality of fuel injection mechanisms for individually supplying compressed air from the air compressing cylinders to the fuel injection mechanisms.

The invention also provides an engine comprising an engine block defining a plurality of engine cylinders, a like plurality of the fuel injection mechanism respectively connected to the engine cylinders, a crankshaft rotatably mounted on the engine block and having an axis, a like plurality of pistons respectively movable in the cylinders, means connecting the crankshaft to the pistons for effecting piston reciprocation in the cylinders in response to crankshaft rotation, and means for supplying air to the cylinders and for discharging air from the cylinders in response to piston reciprocation.

The invention also provides an engine comprising an engine block, a crankshaft rotatably mounted on the engine block, having an axis, and including a cylindrical surface in eccentric relation to the crankshaft axis, a plurality of cylinders supported by the engine block in a common plane and having respective axes extending radially from the crankshaft axis, a plurality of pistons respectively movable in the cylinders, a plurality of connecting rods respectively pivotally connected to the pistons, a drive hub rotatably mounted on the crankshaft surface and pivotally connected to the connecting rods such that rotation of the crankshaft causes reciprocation of the pistons in the cylinders, and means for supplying air to the cylinders and for discharging air from the cylinders in response to piston reciprocation.

One of the principal features of the invention is an arrangement for supplying compressed air in response to crankshaft rotation to a fuel injection mechanism associated with an engine cylinder and in preselected timed relation to crankshaft rotation.

Other features and advantages of the invention will become apparent to those skilled in the art upon review of the following detained description, claims and drawings.

IN THE DRAWINGS

Figure 1:
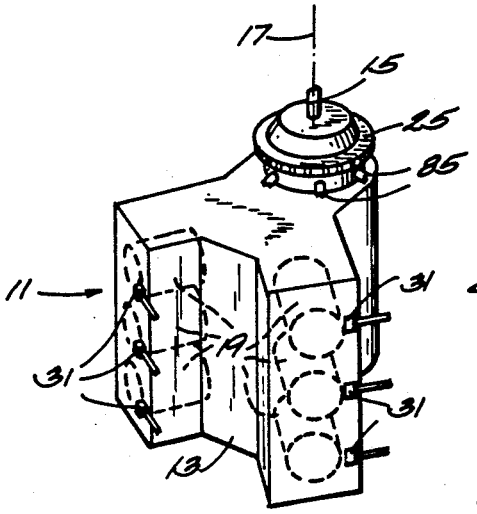
FIG. 1 is a diagrammatic perspective view of an internal combustion engine incorporating various of the features of the invention.

Before one embodiment of the invention is explained in detail, it is to be understood that the invention is not limited in its application to the details of the construction and the arrangements of components set forth in the following description or illustrated in the drawings. The invention is capable other embodiments and of being practiced or being carried out in various ways. Also, it is to be understood that the phraseology and terminology used herein is for the purpose of description and should not be regarded as limiting.

GENERAL DESCRIPTION

Shown in FIG. 1 of the drawings is an internal combustion engine 11 including an engine block 13 supporting a crankshaft 15 for rotation about an axis 17 by suitable means. The crankshaft 15 can be operably associated with any suitable number of engine cylinders or combustion chambers 19 and the engine can be either of the two-stroke or four-stroke type. In the illustrated construction, it is contemplated that the engine 11 includes six cylinders 19 firing at even intervals of crankshaft rotation. Other multiples of engine cylinders and time intervals can also be employed.

Supported by the crankshaft, at one end thereof, is a flywheel 25 which can be of any suitable construction and which is fixed to the crankshaft 15 for common rotation therewith.

Figure 6:
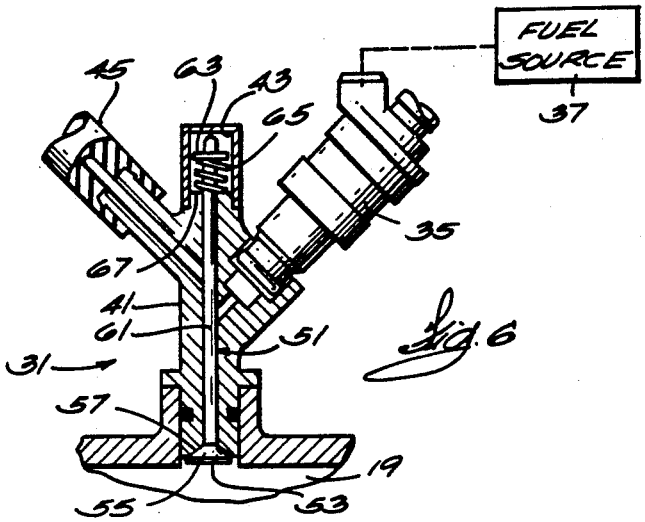
FIG. 6 is a fragmentary enlarged view, partially in section, of a portion of the internal combustion engine shown in FIG. 1.

Respectively associated with each of the engine cylinders 19 is a fuel injecting mechanism 31. All of the fuel injecting mechanisms 31 are of substantially the same construction. One of the fuel injecting mechanisms 31 is shown in FIG. 6 and is located in an aperature in the wall of the associated engine cylinder 19, preferably adjacent to the head end thereof.

Each fuel injecting mechanism 31 includes (See FIG. 6) a commercially available fuel injector 35 which is adapted to be connected to a suitable source 37 of fuel under pressure, which is solenoid operated, and which, in response to electrical actuation, discharges a measured quantity of fuel at a preselected time and over a preselected time interval.

The fuel injecting mechanism 31 also includes a valve body 41 which includes therein a blind bore 43 which communicates with the associated engine cylinder 19, which communicates with the associated fuel injector 35, and which communicates through a suitable conduit or duct 45 with a source of pressure gas or air still to be described.

The fuel injecting mechanism 31 also includes a valve member 51 which is movable between open and closed Positions to respectively open and close communication between the bore 43 and the associated combustion chamber or engine cylinder 19. The valve member 51 includes a valve head 53 including a sealing surface 55 sealingly engageably with a valve seat 57 on the valve body 41 in response to movement of the valve member 51 to the closed position.

In addition, the valve member 51 includes a stem 61 extending in the bore 43 from the valve head 53, and connected to suitable means at the closed or blind end of the bore 43 for biasing the valve member 51 to the closed position. While other arrangements can be employed, in the disclosed construction, the inner end of the valve stem 61 includes an enlarged portion 63 which is engaged by one end of a biasing spring 65. The other end of the biasing spring 65 is engaged with a shoulder 67 in the bore 43 to effectively bias the valve member 51 to the closed position.

In operation, fuel and air are simultaneously discharged into the bore 43 at a pressure sufficient to overcome the spring 65 and thereby to displace the valve member 51 to the open position to afford supply to the associated engine cylinder 19 of a measured quantity of fuel carried as a mist by compressed air supplied at the appropriate time through the bore 43. As already explained, the timing and duration of the fuel injection can be electronically controlled.

Also supported by the engine block 13 is means for separately supplying to each of the fuel injection mechanisms 31, at the desired time, a charge of compressed air. While various arrangements can be employed, in the disclosed construction, such means comprises, for each fuel injection mechanism 31, (See FIG. 2) an air compressing cylinder 81 and an air compressing piston 83 operable therein to compress a suitable volume of air for discharge through a compressed air supply conduit 85 to the associated conduit or duct 45 of an associated fuel injection mechanism 31 and into the associated engine cylinder 19. Thus in the disclosed six-cylinder engine 11, six air compressing cylinders 81 and associated air compressing pistons 83, as well as six supply conduits 85 are provided.

Figure 3:
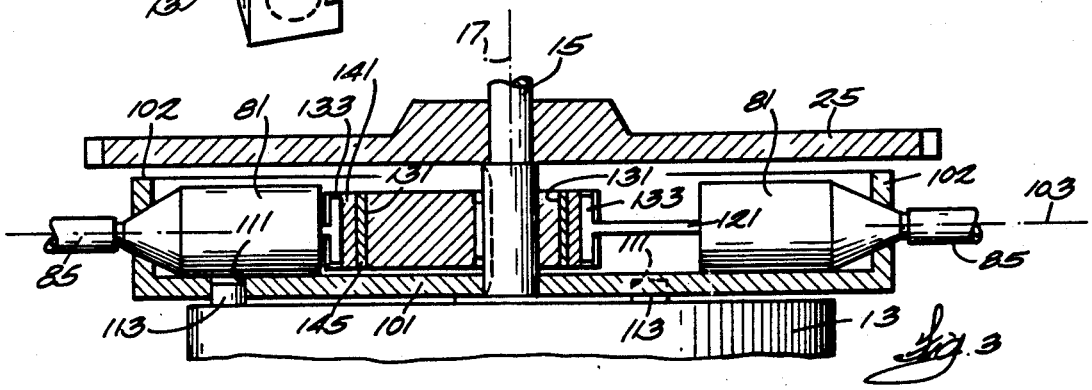
FIG. 3 is a view taken generally along line 3—3 of FIG. 2.
Figure 2:
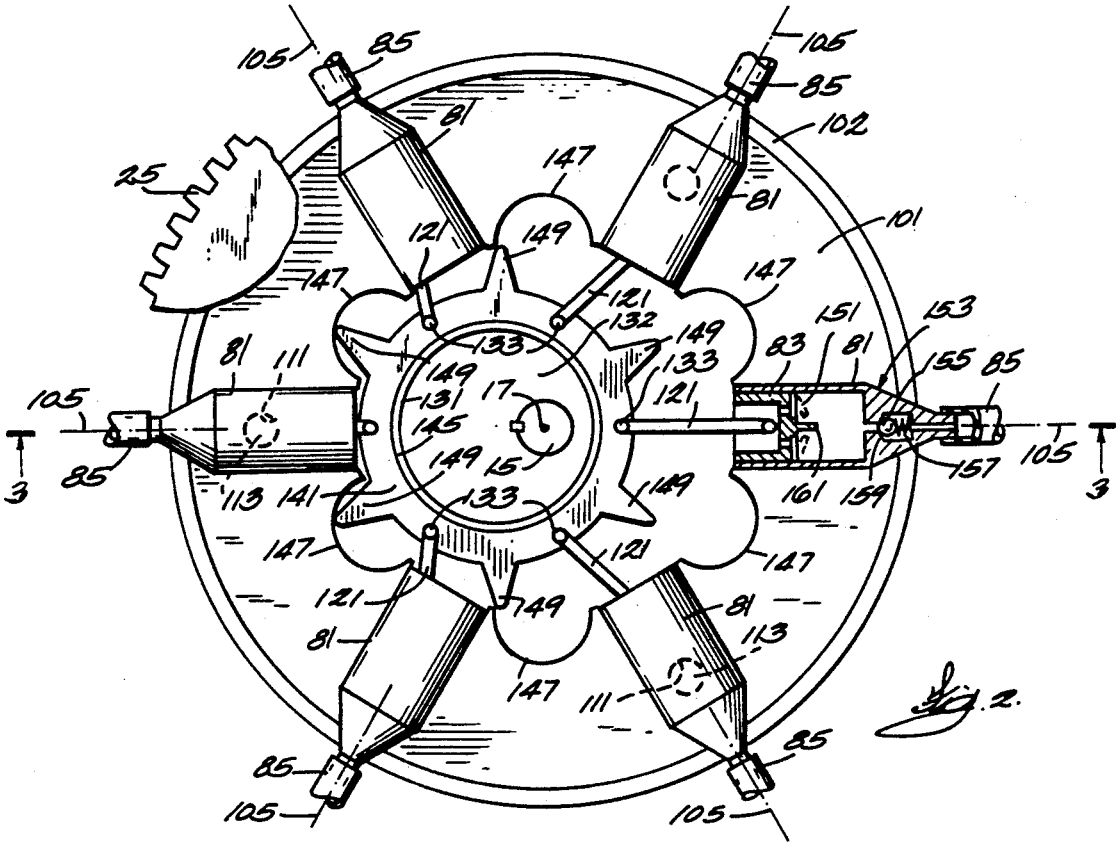
FIG. 2 is a fragmentary enlarged view, partially in section, of a portion of the internal combustion engine shown in FIG. 1.

The air compressing cylinders 81 are fixedly carried or supported by a base plate 101 which is suitably supported on the engine block 13 against rotation and which can include, as shown in FIGS. 2 and 3, an upstanding cylindrical side wall 102.

The air compressing cylinders 81 are preferably located in a common plane which is indicated (See FIG. 3) at 103, which extends transversely of the crankshaft axis 17, and which is preferably located between the engine block 11 and the flywheel 25. More specifically, the air compressing cylinders 81 are arranged in a circular array and have respective axes 105 extending in the common plane 103 and intersecting the crankshaft axis 17. The radially outer ends of the air compressing cylinders 81 are closed and extend through the side wall 102. The radially inner ends of the air compressing cylinders 81 are open. If desired, the air compressing cylinders 81 could be intregrally formed in the engine block 13 either above or below the engine cylinder or cylinders 19.

Means are provided for reciprocating the air compressing pistons 83 in the air compressing cylinders 81 in response to crankshaft rotation. While other constructions can be employed, in the disclosed construction, such means comprises interengaging means on the base plate 101 and on the engine block 13 for preventing rotation of the air compressing cylinders 81 relative to the engine block 13. While various arrangements can be employed, the disclosed arrangement comprises (See FIG. 3) a plurality of recesses 111 in the base plate 101, and a plurality of lugs 113 which project from the engine block 13 and which are received in the recesses 111 to prevent rotation of the air compressing cylinders 81 relative to the engine block 13.

In addition, such means includes respective connecting rods 121 pivotally connected at their outer ends to the air compressing pistons 83, and means for displacing the connecting rods 121 to obtain air compressing piston reciprocation in response to crankshaft rotation. While other constructions can be employed, in the disclosed construction, such means includes a circular or annular surface 131 formed on the crankshaft 15 in eccentric relation to the crankshaft axis 17.

Also included is a drive hub 141 located in encircling relation to the cylindrical surface 131 of a drive member 132 fixed to the crank shaft 15. The drive hub 141 is also pivotally connected to the enlarged inner ends 133 of the connecting rods 121 so that crankshaft rotation causes circular drive hub movement which, in turn, causes connecting rod movement which, in turn, causes reciprocation of the air compressing pistons 83 in the air compressing cylinders 81. Preferably, a suitable bearing 145 is provided between the cylindrical surface 131 and the drive hub 141.

Means are also provided for preventing free rotation of the drive hub 141 relative to the eccentric cylindrical surface 131 on the crankshaft 15 in order to insure air compressing movement of the pistons 83. While other arrangements can be provided, in the disclosed construction, such means comprises forming the base plate 101 with an aperture or opening including a plurality of scallops or recesses 147, and forming the drive hub 141 with a like plurality of teeth 149 which respectively engage and cooperate with the scallops to prevent free relative rotation between the drive hub 141 and the cylindrical surface 131, while at the same time, affording limited rotation between the drive hub 141 and the cylindrical surface 131 and cyclical orbital movement of the drive hub 141 about the crankshaft axis 17 without rotation thereof about the crankshaft axis 17. In this regard, in operation, at any one time, two of the teeth 149 are engaged with the associated scallops 147 to prevent free rotation while affording nutation of the drive body 141. Consequently, the drive body 141 has transilitory movement in a circular path having a constant radius about the crankshaft axis 17, which transilitory movement affords reciprocation of the pistons 83 in the compressing cylinders 81.

Means are also provided for supplying air to the air compressing cylinders 81 and for permitting discharge of air from the air compressing cylinders 81 in response to air compressing piston reciprocation and in predetermined timed relation to crankshaft rotation. While other constructions can be employed, in the disclosed construction, such means includes respective one-way inlet reed valves 151 or other suitable valves in the air compressing pistons 81, and one-way outlet valves 153 or other suitable valves in the otherwise blind outer ends of the air compressing cylinders 81. In this last regard, the outlet valves 153 preferably each include a ball 155 which is seated by a spring 157 against a valve seat 159 to retain the valve 153 closed. In addition, the air compressing pistons 83 are each provided with a Pin or projection 161 which, in response to approach of the respective air compressing pistons 83 to the blind ends of the respective air compressing cylinders 81, engages the ball 155 to open the outlet valve 153 and to permit discharge of the air under compression in the air compressing cylinder 81. By this means, and by properly angularly locating the air compressing cylinders 81 about the crankshaft axis 17, the timing of the discharge of the compressed air from the air compressing cylinders 81 can be closely controlled. As a consequence, compressed air can be supplied to the fuel injecting mechanisms 31 at the desired time for mixture with injected fuel and for conveyance of the mixture past the valve heads 53 and into the associated engine cylinders 19.

Figure 5:
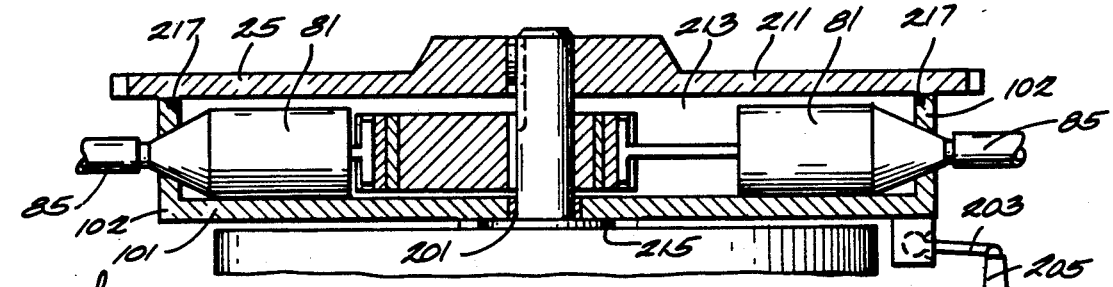
FIG. 5 is a view taken along line 5—5 of FIG. 4.
Figure 4:
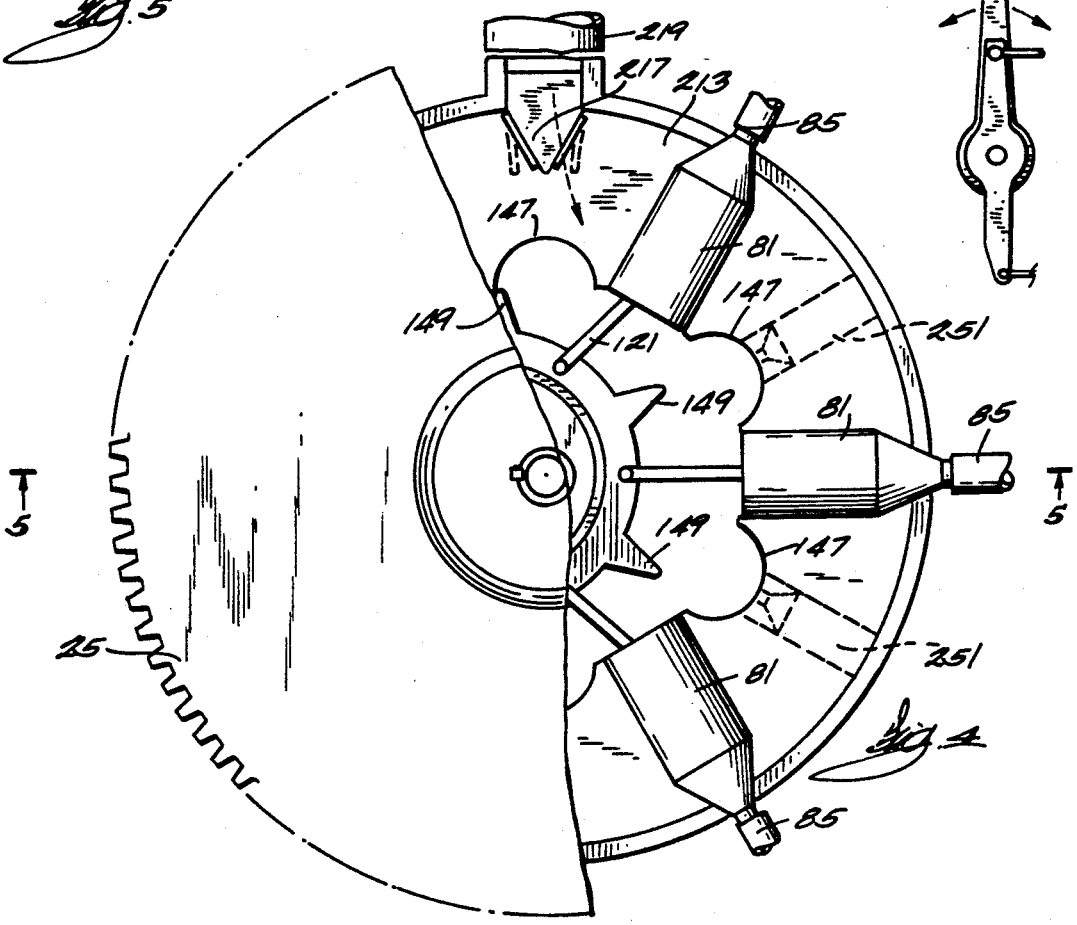
FIG. 4 is a view similar to FIG. 2 showing another internal combustion engine embodying various of the features of the invention.

In another embodiment of the invention shown in FIGS. 4 and 5, the base plate 101 can be mounted on the engine block 13 for rotation about the crankshaft axis 17 by a bearing 201 and can be connected by a suitable linkage 203 for rotating the base plate 101 relative to the engine block 13 to change the time of air flow into the cylinders 19 in relation to engine speed and/or relation to the setting of a pivotably mounted throttle lever 205 in much the same way that the timer base of an ignition circuit is adjusted to vary the time of spark ignition in accordance with throttle setting, as set forth, for instance, in U.S. Pat. No. 4,606,602 issued July 29, 1982, and incorporated herein by reference.

In still another embodiment shown in FIGS. 4 and 5, the base plate can be covered with a cap or cover 211 which can be the rotating flywheel 25 (as shown in FIG. 4), or which can be a fixed member (not shown) and which creates a substantially sealed intake compartment 213 containing the air compressing cylinders and the arrangement for compressing air in the air compressing cylinders 81. In this embodiment suitable rotary seals 215 can be provided in the area where the crankshaft enters and/or leaves the sealed compartment. In addition, if the cover 211 is provided by the flywheel 25, a rotary seal 217 can be provided between the flywheel 25 and the cylindrical side wall 102. Under such circumstances, and if desired, the air compressing or intake compartment 213 can be fed pre-compressed air from the engine crankcase (not shown). As a consequence, the resulting pressures in the cylinders 19 will vary with the throttle opening, thereby allowing automatic air mass compensation as the engine operates between idle and wide-open throttle settings. Alternatively, as shown in FIG. 4, the side wall of the chamber 213 can be provided with a one-way reed valve 217 or other suitable valve affording in flow of air into the closed chamber 213 from a suitable air intake conduit 219.

In still another embodiment which employs a substantially sealed intake chamber, such as the chamber 213, one or more fuel injectors 251 shown in dotted out-line can be located on the base plate 101, or in the chamber 213, or in the inlet air supply conduit 219, for injecting fuel into the air prior to compression of their mixture in the compressing cylinders 81. In such an embodiment, the fuel mixture would travel in the conduits to the valve and the use of a fuel injector at each cylinder 19 could be omitted. In addition, a fewer number of fuel injectors, as compared to the number of cylinders, could be employed. For instance, in a six-cylinder engine, two or three fuel injectors could be employed and, furthermore, they could all be discharged simultaneously which would greatly simplify the electronics of the fuel injector control mechanism.

It is noted that the air compressing cylinders 81 are preferably sized to furnish about one cubic foot of air per minute to each cylinder when the engine 11 is operating at about three-thousand rpm. This volume approximately provides the amount of air which affords good fuel atomization and delivery to the cylinders 19 through a properly configured valve bodies, such as, for instance, the valve body 41 disclosed herein. However, other designs which also provide proper fuel atomization can also be employed.

It is also noted that the air volume contained in the conduits 45, 85 and valve body bores 43 is small as compared to the volume of the air compressors 81 so that, during each cycle, the compressed air travels with sufficient velocity to properly atomize the fuel.

Various of the features of the invention are set forth in the following claims.

I claim:

1. An engine an engine block defining an engine cylinder, a crankshaft rotatably mounted on said engine block, means for compressing air in response to crankshaft rotation and comprising an air compressing cylinder supported on said engine block, having an axis extending radially from the axis of said crankshaft, and located in a substantially sealed chamber, means for supplying compressed air from said air compressing means to said fuel injection mechanism in preselected timed relation to crankshaft rotation a crankcase subject to cylical positive pressure conditions, a conduit communicating between said chamber and said crankcase and including therein control means permitting flow to the chamber and preventing flow from the chamber, and a fuel injector communicating with one of the closed chamber and the conduit downstream of the control means.

2. An engine comprising an engine block defining an engine cylinder, a crankshaft rotatably mounted on said engine block, means for compressing air in response to crankshaft rotation and including an air compressing cylinder supported on said engine block, having an axis extending radially from the axis of said crankshaft, and located in a chamber which is closed except for an air intake opening and which includes a fuel injection mechanism including a selectively operable fuel injector for injecting fuel into said chamber, and means for supplying compressed air from said air compressing cylinder to said fuel injection mechanism in preselected timed relation to crankshaft rotation.

3. An engine comprising an engine block defining an engine cylinder, a fuel injection mechanism connected to said engine cylinder, a crankshaft rotatably mounted on said engine block and having an axis, means for compressing air in response to crankshaft rotation and comprising an air compressing cylinder mounted on said engine block for rotation relative thereto and having an axis extending radially from the axis of said crankshaft, means for supplying the compressed air from said air compressing cylinder to said fuel injection mechanism in preselected timed relation to cranksahft rotation, a throttle, and a linkage connecting said cylinder to said throttle for angularly adjusting said cylinder about said crankshaft axis in accordance with the position of said throttle.

4. An engine comprising an engine block defining a plurality of engine cylinders, a like plurality of fuel injection mechanisms respectively connected to said engine cylinders, a crankshaft rotatably mounted on said engine block and having an axis, a like plurality of air compressing cylinders supported on said engine block and having respective axes extending radially from said crankshaft axis, a like plurality of air compressing pistons respectively movable in said air compressing cylinders, means for admitting air to said air compressing cylinders in response to air compressing piston movement, means for discharging air from said air compressing cylinders in response to air compressing piston movement, means connecting the crankshaft to said air compressing pistons for effecting air compressing piston reciprocation in the air compressing cylinders in response to crankshaft rotation, and means respectively connecting said plurality of air compressing cylinders to said plurality of fuel injection mechanisms for individually supplying compressed air from said air compressing cylinders to said fuel injection mechanisms.

5. An engine comprising an engine block defining a plurality of engine cylinders, a like plurality of fuel injection mechanisms respectively connected to said engine cylinders, a crankshaft rotatably mounted on said engine block and having an axis, a like plurality of air compressing cylinders mounted on said engine block for rotation relative thereto and having an axis, a like plurality of air compressing cylinders supported on said engine block and having respective axes extending radially from said crankshaft axis, a like plurality of air compressing pistons respectively movable in said air compressing cylinders, means for admitting air to said air compressing cylinders in response to air compressing piston movement, means for discharging air from said air compressing cylinders in response to air compressing piston movement, means connecting the crankshaft to said air compressing pistons for effecting air compressing piston reciprocation in the air compressing cylinders in response to crankshaft rotation, means respectively connecting said plurality of air compressing cylinders to said plurality of fuel injection mechanisms for individually supplying compressed air from said air compressing cylinders to said fuel injection mechanisms, a throttle, and a linkage connecting said cylinders to said throttle for angularly adjusting said cylinders about said crankshaft axis in response to movement of said throttle.

6. An engine comprising an engine block, a crankshaft rotatably mounted on said engine block and having an axis, a plurality of cylinders supported by said engine block in a common plane and having respective axes extending radially from said crankshaft axis, a like plurality of pistons respectively movable in said cylinders, means connecting said crankshaft to said pistons for effecting piston reciprocation in said cylinders in response to crankshaft rotation, and means for supplying air to said cylinders and for discharging air from said cylinders solely in response to piston reciprocation in said cylinders.

7. An engine comprising an engine block, a crankshaft rotatably mounted on said engine block, having an axis, and including a cylindrical surface in eccentric relation to said crankshaft axis, a plurality of cylinders supported by said engine block in a common place and having respective axes extending radially from said crankshaft axis, a plurality of pistons respectively movable in said cylinders, a plurality of connecting rods respectively pivotally connected to said pistons, a drive hub rotatably mounted on said crankshaft surface and pivotally connected to said connecting rods such that rotation of said crankshaft causes reciprocation of said pistons in said cylinders, and means for supplying air to said cylinders and for discharging air from said cylinders solely in response to piston reciprocation in said cylinders.

8. An engine comprising an engine block defining an engine cylinder, a fuel injection mechanism connected to said engine cylinder, a crankshaft rotatably mounted on said engine block, means for compressing air in response to crankshaft rotation, and means for supplying the compressed air to said fuel injection mechanism in preselected timed relation to crankshaft rotation, said means for compressing air comprising an air compressing cylinder supported on said engine block and having an axis extending radially from the axis of said crankshaft, said air compressing cylinder being located in a chamber which is closed except for an air intake opening.

9. An engine in accordance with claim 8 wherein said means for compressing air further comprises an air compressing piston movable in said air compressing cylinder, means for admitting air to said air compressing cylinder in response to air compressing piston movement, means for discharging air from said compressing cylinder in response to air compressing piston movement, and means connecting said crankshaft to said air compressing piston for effecting air compressing piston movement in said air compressing cylinder in response to crankshaft rotation.

10. An engine comprising an engine bock defining an engine cylinder, a fuel injection mechanism connected to said engine cylinder, a crankshaft rotatably mounted on said engine block, means for compressing air in response to crankshaft rotation, and means for supplying the compressed air to said fuel injection mechanism in preselected timed relation to crankshaft rotation, the engine including a plurality of said cylinders, a like plurality of said fuel injection mechanisms respectively connected to said engine cylinders, a like plurality of said means for compressing air, and a like plurality of means for respectively supplying the compressed air from said air compressing means to said fuel injection mechanisms.

11. An engine in accordance with claim 10 wherein each of said means for compressing air comprises an air compressing cylinder supported on said engine block and having an axis extending radially from the axis of said crankshaft.

12. An engine comprising an engine block defining an engine cylinder, a fuel injection mechanism including a bore communicating with said engine cylinder, a fuel injector communicating with said bore and adapted to be connected to a source of fuel, a crankshaft rotatably mounted on said engine block, means for compressing air in response to crankshaft rotation, and exclusively mechanical means for supplying compressed air from said air compressing means to said bore in preselected timed relation to crankshaft rotation.

13. An engine in accordance with claim 12 wherein said means for compressing air comprises an air compressing cylinder supported on said engine block and having an axis extending radially from the axis of said crankshaft.

14. An engine in accordance with claim 13 wherein said means for compressing air further comprises an air compressing piston movable in said air compressing cylinder, means for admitting air to said air compressing cylinder in response to air compressing piston movement, means for discharging air from said compressing cylinder in response to air compressing piston movement, and means connecting said crankshaft to said air compressing piston for effecting air compressing piston movement in said air compressing cylinder in response to crankshaft rotation.

15. An engine comprising an engine block defining an engine cylinder, a fuel injection mechanism connected to said engine cylinder, a crankshaft rotatably mounted on said engine block, a flywheel mounted on the crankshaft, means for compressing air in response to crankshaft rotation, and means for supplying the compressed air to said fuel injection mechanism in preselected timed relation to crankshaft rotation, the means for compressing air being located between the engine block and the flywheel.

16. An engine in accordance with claim 15 wherein said means for compressing air comprises an air compressing cylinder supported on said engine block and having an axis extending radially from the axis of said crankshaft.

17. An engine in accordance with claim 16 wherein said means for compressing air further comprises an air compressing piston movable in said air compressing cylinder, means for admitting air to said air compressing cylinder in response to air compressing piston movement, means for discharging air from said compressing cylinder in response to air compressing piston movement, and means connecting said crankshaft to said air compressing piston for effecting air compressing piston movement in said air compressing cylinder in response to crankshaft rotation.

18. An engine comprising an engine block defining an engine cylinder, a fuel injection mechanism connected to said engine cylinder, a crankshaft rotatably mounted on said engine block, the crankshaft including an axis, means for compressing air in response to crankshaft rotation, and means for supplying the compressed air to said fuel injection mechanism in preselected timed relation to crankshaft rotation, the means for supplying compressed air to said mechanism including means for preventing rotation of the air compressing means relative to the crankshaft axis.

19. An engine in accordance with claim 18 wherein said means for compressing air comprises an air compressing cylinder supported on said engine block and having an axis extending radially from the axis of said crankshaft.

20. An engine in accordance with claim 19 wherein said means for compressing air further comprises an air compressing piston movable in said air compressing cylinder, means for admitting air to said air compressing cylinder in response to air compressing piston movement, means for discharging air from said compressing cylinder in response to air compressing piston movement, and means connecting said crankshaft to said air compressing piston for effecting air compressing piston movement in said air compressing cylinder in response to crankshaft rotation.

* * * * *